US011255115B2

(12) United States Patent
Kongshammer

(10) Patent No.: US 11,255,115 B2
(45) Date of Patent: Feb. 22, 2022

(54) LOCKING SYSTEM AND USE THEREOF

(71) Applicant: Mavako ApS, Farum (DK)

(72) Inventor: Martin Kongshammer, Herlev (DK)

(73) Assignee: Mavako ApS, Farum (DK)

( * ) Notice: Subject to any disclaimer, the term of this patent is extended or adjusted under 35 U.S.C. 154(b) by 240 days.

(21) Appl. No.: 16/472,537

(22) PCT Filed: Dec. 19, 2017

(86) PCT No.: PCT/DK2017/050442
§ 371 (c)(1),
(2) Date: Jun. 21, 2019

(87) PCT Pub. No.: WO2018/113884
PCT Pub. Date: Jun. 28, 2018

(65) Prior Publication Data

US 2020/0308886 A1 Oct. 1, 2020

(30) Foreign Application Priority Data

Dec. 23, 2016 (DK) ..... PA201671050
Sep. 14, 2017 (DK) ..... PA201770692

(51) Int. Cl.
*E05C 19/00* (2006.01)
*E05B 67/38* (2006.01)
*E05B 83/02* (2014.01)
*E05C 19/18* (2006.01)

(52) U.S. Cl.
CPC ..... *E05C 19/003* (2013.01); *E05B 67/383* (2013.01); *E05B 83/02* (2013.01); *E05Y 2900/604* (2013.01)

(58) Field of Classification Search
CPC ..... E05C 19/003; E05C 19/184; E05C 7/00; E05C 19/18; E05C 19/182; E05C 19/188; E05Y 2900/604; E05B 67/383; E05B 83/02
USPC ..... 70/14, 54–56, 129, DIG. 43, DIG. 56, 70/199, 200, 211, 212; 292/258, 259 R, 292/259 A, 260, 288, 289, 291, 292, 294, 292/295, 148, DIG. 32
See application file for complete search history.

(56) References Cited

U.S. PATENT DOCUMENTS 3,181,319 A * 5/1965 Antoinette ..... E05C 19/182 70/14
3,599,453 A * 8/1971 Bauernfeind ..... E05C 1/04 70/129
4,399,672 A * 8/1983 Moorhouse ..... E05C 19/18 292/289
4,669,282 A * 6/1987 Hoyt ..... E05B 63/0052 292/140

(Continued)

FOREIGN PATENT DOCUMENTS

EP 1 845 225 A1 10/2007
GB 2 233 036 A 1/1991

(Continued)

*Primary Examiner* — Lloyd A Gall
(74) *Attorney, Agent, or Firm* — Birch, Stewart, Kolasch & Birch, LLP

(57) ABSTRACT

A locking system for locking of an enclosure that is provided with at least one and preferably two doors or gates is provided. The locking system comprising a lock holding device with a bent piece for mounting of a locking rod behind the door and a blocking element and a lock.

20 Claims, 4 Drawing Sheets

(56) References Cited

Figure 1:
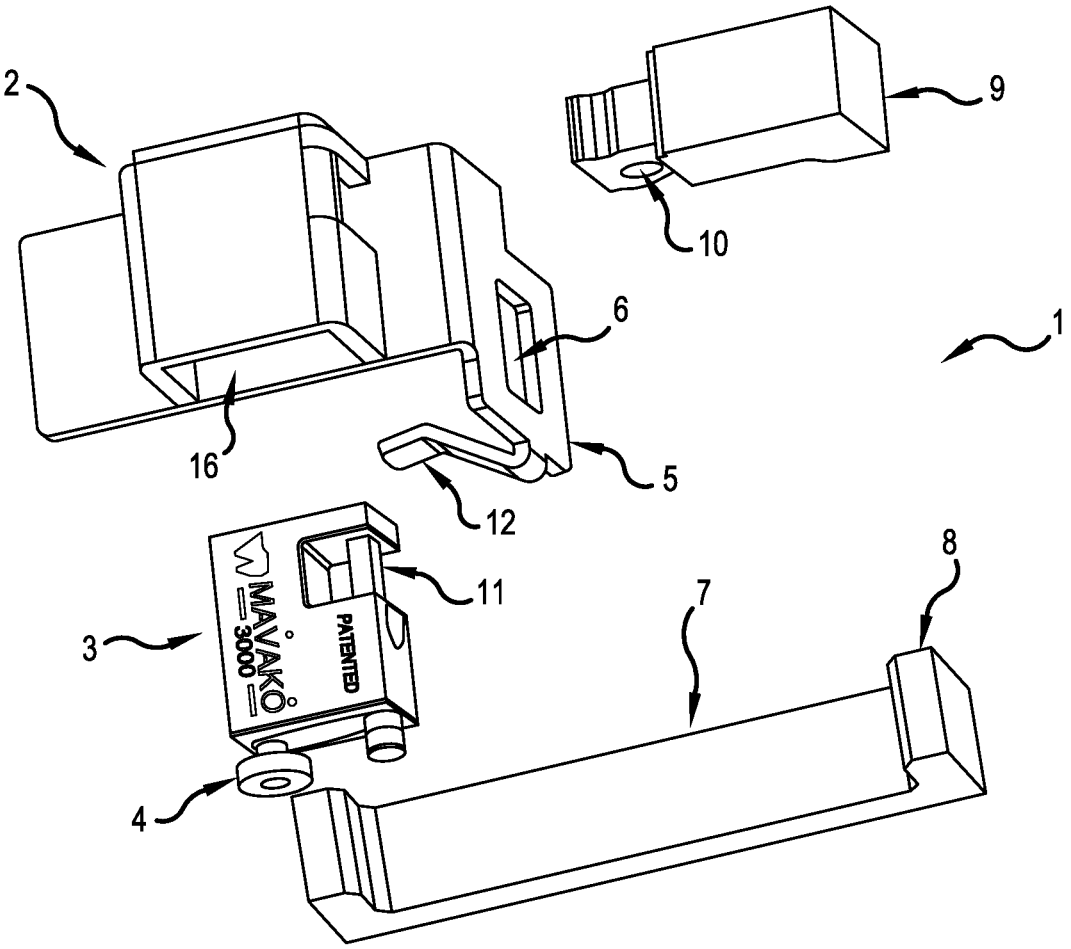

U.S. PATENT DOCUMENTS 5,291,760 A * 3/1994 Schrader ..... E05C 19/18 292/288
5,623,841 A * 4/1997 Deemar ..... E05C 19/182 292/262
5,819,561 A * 10/1998 Blehi, III ..... E05C 19/182 70/14
5,878,604 A 3/1999 Stone et al.
5,931,032 A * 8/1999 Gregory ..... H01F 10/3268 70/129
6,477,872 B1 * 11/2002 Denton, Jr. ..... E05B 67/36 70/100
6,823,701 B1 * 11/2004 Gogel ..... E05B 13/001 292/148
7,047,774 B1 * 5/2006 Gogel ..... E05B 65/0021 70/100
7,272,963 B2 * 9/2007 Rosenberg ..... E05B 65/0007 292/175
7,757,523 B1 * 7/2010 Garcia ..... E05B 65/0007 70/129
8,132,434 B2 * 3/2012 Buis ..... E05B 63/0004 70/14
8,245,546 B2 * 8/2012 Olsson ..... E05B 67/38 70/14
8,561,440 B1 * 10/2013 Sierra ..... E05B 17/0058 70/129
9,341,002 B2 * 5/2016 Kongshammer ... E05B 65/0007
2005/0061041 A1 3/2005 Rosenberg et al.
2012/0305565 A1 12/2012 Hansen
2015/0292243 A1 10/2015 Kongshammer
2021/0079698 A1 * 3/2021 Kongshammer ..... B65D 90/22

FOREIGN PATENT DOCUMENTS

GB 2504448 A 2/2014
WO WO 03/054331 A1 7/2003

* cited by examiner

LOCKING SYSTEM AND USE THEREOF

The invention relates to a locking system for mounting at a door to lock an enclosure that is provided with at least one and preferably two doors or gates.

Furthermore, the invention relates to the use of a locking system to lock transportable containers including shipping containers.

It is known to lock containers such as shipping containers with locking systems.

However, there are some drawbacks to the known locking systems for shipping containers, including the need for special brackets that for instance is welded or bolted onto the shipping container using heavy hand tools. Furthermore, it turns out that they have shown not to be sufficiently robust in relation to violent attacks on the locks in connection with break-ins.

An example of a known locking system for shipping containers is described in US 2012/0305565 A1, where the locking system is installed on the front centre post between the right and the left door. Furthermore, angled edges are welded thereto, in which a sled can slide. From the outside a handle can push the sled down, whereby the sled pushes a locking rod down over the tabs situated on the end surfaces, one on the right and one on the left door, that face each other. In a similar manner, the sled can be moved upwards, when the lock is in open position, so that the locking rod is lifted up. When opening, a blocking element traversing the door, is, at the same time, slid a further distance out and away from the inner side towards the outer side of the door. If the lock is locked, this movement is prevented, and activation of the handle cannot move the sled, but instead a spring is deflected, the passive position of which corresponds to the locked position of the locking system. The described lock is only suited for shipping containers with a centre post and is not strong enough the resist a pull from a four wheel drive car.

Consequently, it is the object of the invention to devise a locking system for locking for instance a shipping container, without the lock being built into for example a shipping container structure, and which is robust against attempted break-ins, for instance with a four wheel drive car.

The object of the invention is met by means of a locking system of the type described in the claims, which is characterized in that, furthermore, the lock holding device is adapted to be mounted on the inside of a door, said lock holding device further comprising a second flat surface as for example a bent flat surface piece that is perpendicular to the larger surface of the door or the larger surface of a frame, where the flat piece has a fastening means for fastening of said locking rod, such as a hole or a groove, through which one end of a locking rod can pass, or a locking rod can fit into, as well as a blocking element that is provided to be part of the lock and to be locked, so that the door cannot be opened.

The lock holding device is, according to an embodiment of the invention, shaped in such a way that it can be inserted over an end edge of a door and be fastened thereto with a means such as a thumb screw on the inner side of the door, said lock holding device further being provided with a guide for a locking rod and is furthermore provided with a shield that can partly enclose a lock, including a padlock.

In this way it is possible to mount the locking system on for instance a shipping container without the need for welding or tools.

Further advantageous embodiments of the locking system are described in the dependent claims.

Figure 2:
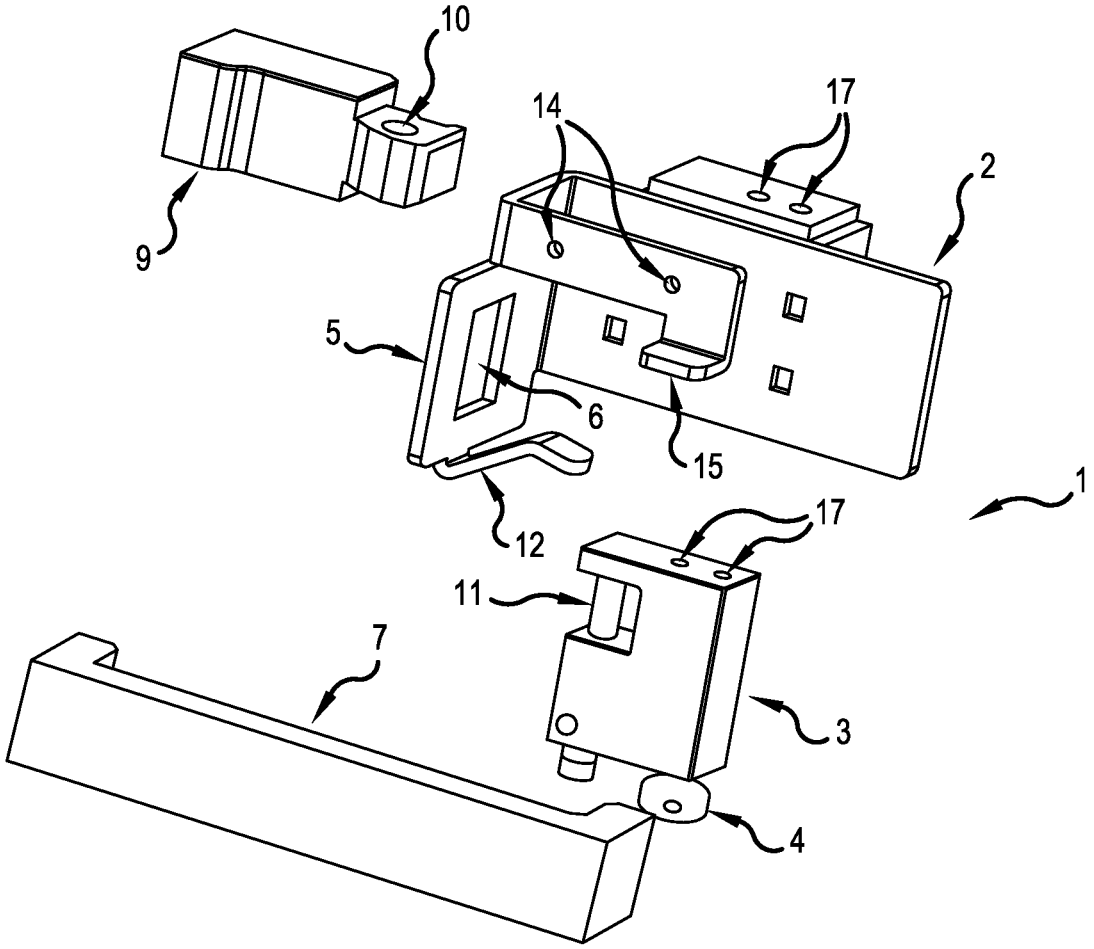
Figure 3:
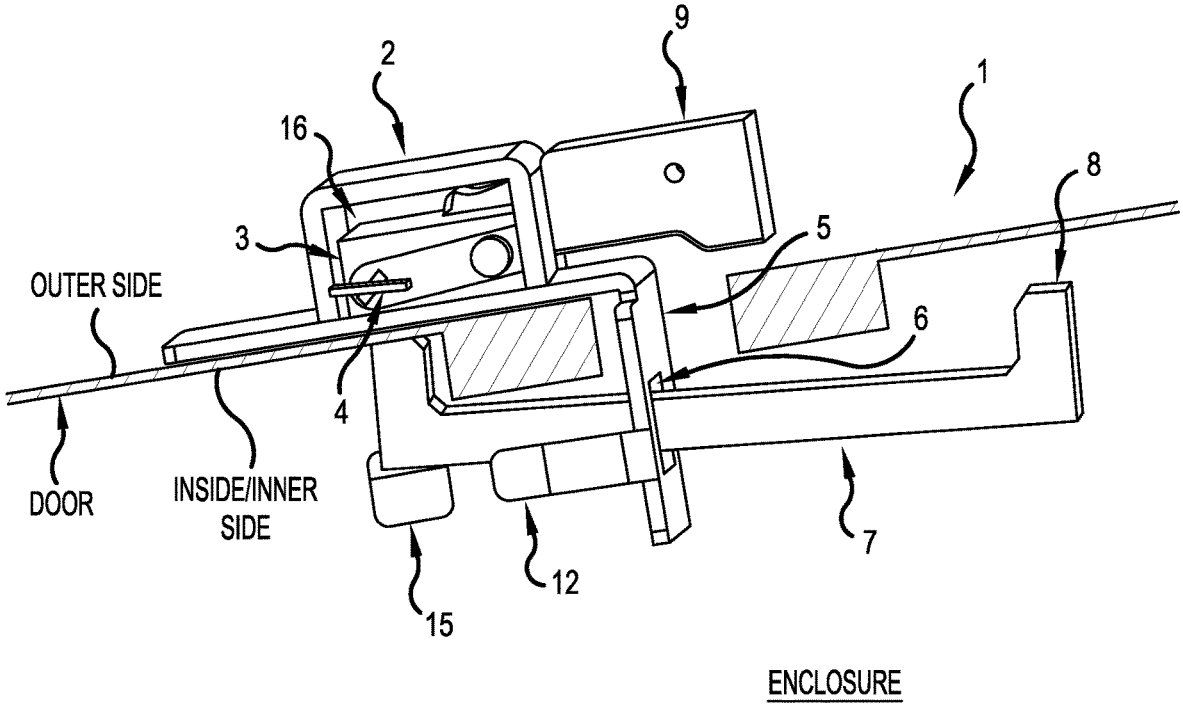

To promote a better understanding of the invention, some examples of embodiments will be described in further detail referring to the FIGS, in which:

FIG. 1 shows an example of an embodiment of a locking system according to the invention, from the front side and in exploded view, FIG. 2 shows an example of an embodiment of the same locking system as in FIG. 1, seen from behind and again in exploded view, FIG. 3 shows the embodiment in FIG. 1 with the parts assembled after mounting on for instance a shipping container door. The container door and the means for fastening of the device with for instance two thumb screws are not shown.

Figure 4:
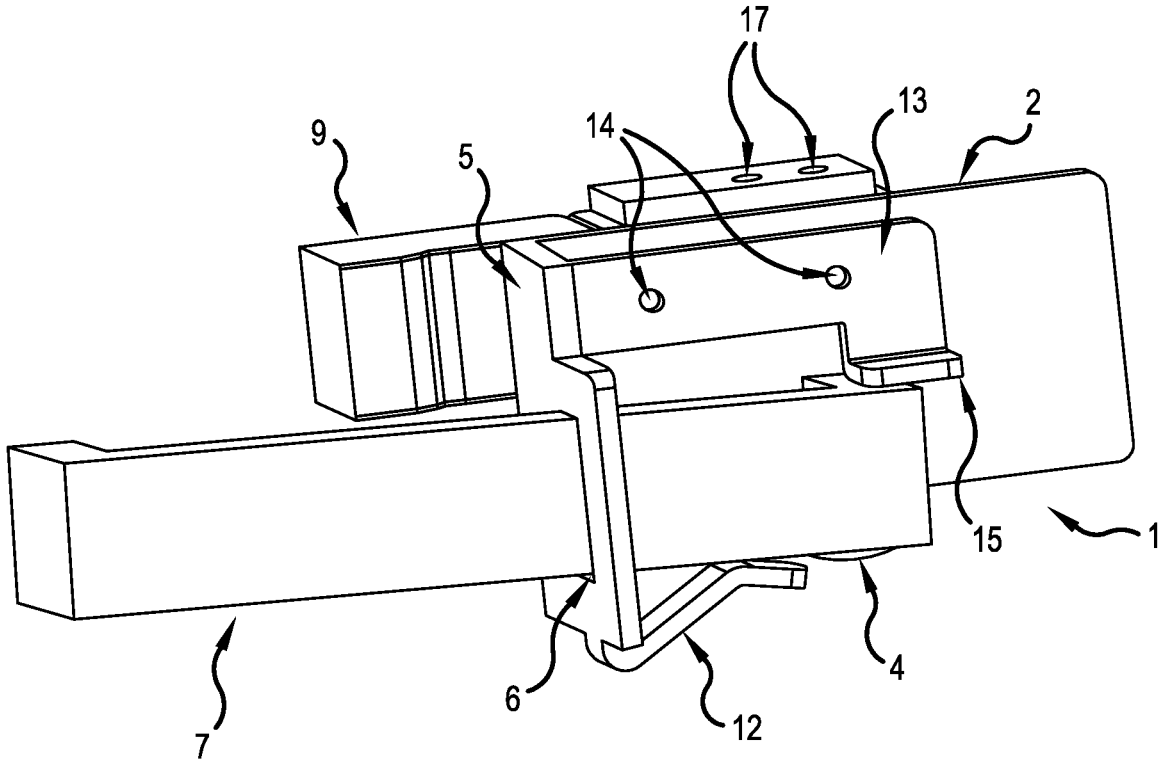

FIG. 4 shows the embodiment of FIG. 2, where the parts are assembled after mounting on for instance a container door. The container door and the means for fastening of the device with for instance two thumb screws are not shown.

DETAILED DESCRIPTION

FIG. 1 shows a locking system 1 according to the invention, with the parts of the system shown with mutual distance. The lock holding device 2 can hold a lock 3. The key 4 can be seen in the lock on the FIG. The lock holding device 2 has a connecting part 5 in a position perpendicular to the contact surface of the lock holding device against the door that must be shut and locked. The lock holding device 2 has a rectangular bore 6 in the connecting part 5, in which to insert the locking rod 7. The locking rod 7 has two end flanges 8. Furthermore, there is a blocking element 9 having a protrusion that can be inserted in the lock holding device 2. The blocking element 9 has a bore 10 in the protrusion into which the shackle 11 of the lock 3 fits. The lock holding device 2 also has a guide 12 to support of the locking rod 7 when it is inserted.

FIG. 2 shows the same locking system as in FIG. 1, but seen from behind. In addition to the parts shown in FIG. 1, the FIG. shows a structure 13 with two bores 14, for instance for thumb screws (not shown) for fastening of the lock holding device to for example a door. The structure 13 also has an angled flange 15 that functions to restrict the possible movements of an inserted rod 7.

FIG. 3 shows the same locking system 1 as in FIG. 1, but with the parts assembled. The FIG. shows the locking system 1 in the locked position, in which the lock 3 is located in the hole 16 that is suitable for this purpose, and the shackle 11 of the lock 3 engages in the hole 10 of the blocking element 9. The key 4 is not yet removed.

The locking rod 7 is in its resting position when the locking rod 7 is in the pushed-back-position. The lock 3 is open in this position so that one can pass unhindered through the door opening without touching the locking rod 7. It is advantageous, if a locking rod 7 for instance has an end flange 8 with such dimensions that one dimension is smaller than one dimension of a hole 6, possibly rectangular, in another surface as for instance a bent flat piece 5 which the locking rod 7 must pass through, and that the other dimension of the end flange is not larger than the other dimension of a possibly rectangular hole 6. In a locked position the flanges 8 grip a frame which is often located on the inner side of the locked door and in a similar way grip a frame on another door or wall edge, so that a pull in the locking system transforms to a pull in the hole container, because the structure at the door closure in this way becomes very strong. The flange 8 that faces the door opening also functions to prevent locking of the door, if the locking rod 7 is not in an extracted position, as this flange in the pushed-back-position will prevent an opposite door or wall closing fully, so that the blocking element 9 cannot be inserted in the lock holding device 2.

When a locking system 1 is locked onto for instance a container door, a locking rod 7 constitutes a counter-hold, as the locking rod 7 in this position abuts two door frames and is fixed to another surface such as a bent flat piece 5 through a hole 6 in the lock holding device 2.

FIG. 4 shows the same locking system 1 as in FIG. 2 which is the same as in FIG. 1 only seen from behind, but with the parts assembled. The FIG. shows the locking system 1 in the locked position. The key 4 is not yet removed. There is also shown a structure 13 and two holes 14 therein to fastening of the lock holding device 2 on a door and two holes 17 in the top of the lock holding device to fastening of the lock 3 in the lock holding device 2.

As shown in FIGS. 1, 2, 3 and 4, a locking rod 7 can advantageously be mounted on the inner side of one of the doors that are to be locked by means of the two holes and for instance thumb screws (not shown). Typically, the locking rod 7 will be provided as a U-profile with short flanges.

For practical reasons, a short piece of chain will be attached between the blocking element 9 and the lock holding device 2, so that the latch is not far away when it is to be mounted, which is helpful if it is dark.

All FIGS. show an embodiment according to the invention comprising:

a lock holding device 2, constituting the first half of the first leg, a locking rod 7 that is typically shaped as an elongated U-profile which, when the locking system 1 is assembled in a closed position with the locking rod in an extracted position, constitutes a second leg that is parallel with the first leg, a blocking element 9 that, inserted in a suitable hole 16 in the lock holding device 2, together with the lock holding device 2 constitutes the first leg that is parallel with the second leg, said two legs being connected via another surface as for instance a bent surface piece 5, and a lock 3 that can prevent movement of the blocking element and consequently opening of the door.

In another embodiment, the lock holding device 2 is fastened as in FIG. 3 where also the locking rod is located, so that one end is situated behind a wall surface that is parallel with and located opposite to the lock holding device 2, so that the door cannot be pulled out.

As it will be understood from the FIGS. shown and the accompanying description, it is easy to mount the locking system onto for instance a shipping container.

All the components for the locking system can suitably be produced in a durable material such as hardened steel.

The invention claimed is:

1. Locking system for locking an enclosure that is provided with at least one door, said locking system comprising:

a lock holding device adapted to be mounted at an end edge surface of the door or an adjacent frame in such a way that a lock that is held by the lock holding device is accessible from the outside of the door, a locking rod that is adapted for mounting at the inside of the door or the adjacent frame and is coupled to the lock holding device, where one end of the locking rod, in the locked position of the door, will abut the inside of the door, and the opposite end thereof will abut a structure adjacent to the door, and a blocking element that is adapted to cooperate with the lock and prevent opening of the door, wherein the lock holding device includes a second flat surface that bends in such a way that the second flat surface piece is perpendicular to the contact surface of the lock holding device, said contact surface facing a larger surface of said door or frame, wherein said second flat surface piece extends from an outer side of the door to an inner side of the door when the locking system is mounted, and wherein said second flat surface piece has a fastening means for fastening of said locking rod in such a way that a pull in the lock holding device can be transferred to the locking rod, and that said blocking element is adapted to be inserted in the lock holding device and to be secured by the lock.

2. Locking system according to claim 1, wherein said fastening means is a hole or a groove for insertion of said locking rod.

3. Locking system according to claim 1, wherein the lock holding device is shaped in such a way that it can be inserted over said end edge surface of said door or adjacent frame and be fastened thereto with a thumb screw on the inner side of the door or frame.

4. Locking system according to claim 1, wherein the locking rod is provided with end flanges that are adapted to extend around a frame edge on the inner side of the door, the other door or the adjacent frame, respectively.

5. Locking system according to claim 1, wherein the lock holding device is also provided with a guide for the locking rod, and is also provided with a shield that partially can enclose the lock, for instance a padlock.

6. Locking system according to claim 1, wherein the locking rod is provided as an elongated U-profile.

7. Locking system according to claim 1, wherein the blocking element is provided with a protrusion that can be inserted into the lock holding device whereby the lock can interact with the protrusion.

8. Use of a locking system according to claim 1 to lock transportable containers including shipping containers.

9. Locking system according to claim 2, wherein the lock holding device is shaped in such a way that it can be inserted over said end edge surface of said door or adjacent frame and be fastened thereto with a thumb screw on the inner side of the door or frame.

10. Locking system according to claim 2, wherein the locking rod is provided with end flanges that are adapted to extend around a frame edge on the inner side of the door, the other door or the adjacent frame, respectively.

11. Locking system according to claim 3, wherein the locking rod is provided with end flanges that are adapted to extend around a frame edge on the inner side of the door, the other door or the adjacent frame, respectively.

12. Locking system according to claim 2, wherein the lock holding device is also provided with a guide for the locking rod, and is also provided with a shield that partially can enclose the lock, for instance a padlock.

13. Locking system according to claim 3, wherein the lock holding device is also provided with a guide for the locking rod, and is also provided with a shield that partially can enclose the lock, for instance a padlock.

14. Locking system according to claim 4, wherein the lock holding device is also provided with a guide for the locking rod, and is also provided with a shield that partially can enclose the lock, for instance a padlock.

15. Locking system according to claim 2, wherein the locking rod is provided as an elongated U-profile.

16. Locking system according to claim 3, wherein the locking rod is provided as an elongated U-profile.

17. Locking system according to claim 4, wherein the locking rod is provided as an elongated U-profile.

18. Locking system according to claim 5, wherein the locking rod is provided as an elongated U-profile.

19. Locking system according to claim 2, wherein the blocking element is provided with a protrusion that can be inserted into the lock holding device whereby the lock can interact with the protrusion.

20. Locking system according to claim 3, wherein the blocking element is provided with a protrusion that can be inserted into the lock holding device whereby the lock can interact with the protrusion.

* * * * *